United States Patent [19]

Kakizaki

[11] Patent Number: 5,013,186

[45] Date of Patent: May 7, 1991

[54] CABLE SHIP

[75] Inventor: Sadao Kakizaki, Shimonoseki, Japan

[73] Assignee: Mitsubishi Jukogyo Kabushiki Kaisha, Tokyo, Japan

[21] Appl. No.: 470,075

[22] Filed: Jan. 25, 1990

[30] Foreign Application Priority Data

Feb. 20, 1989 [JP] Japan ..... 1-39615

[51] Int. Cl.[5] ..... F16L 1/04

[52] U.S. Cl. ..... 405/166; 405/158; 405/168

[58] Field of Search ..... 405/168, 166, 165, 169, 405/158; 242/157 R; 114/242, 253, 254; 254/134.35 C

[56] References Cited

U.S. PATENT DOCUMENTS 3,136,529 6/1964 Dickinson et al. ..... 405/166 X
3,641,778 2/1972 Gibson ..... 405/168

FOREIGN PATENT DOCUMENTS 1293851 4/1962 France ..... 405/166
0025286 2/1988 Japan ..... 405/166

*Primary Examiner*—Dennis L. Taylor
*Attorney, Agent, or Firm*—Wenderoth, Lind & Ponack

[57] ABSTRACT

An improvement in a known cable ship, including a drum type cable engine installed on an inboard deck and a bow sheave disposed at a top portion of a bow for receiving a communication cable payed out from a drum of the cable engine, resides in the provision of an intermediate sheave disposed between the bow sheave and the drum type cable engine. In order to dispose the bow sheave at a high position with respect to the water surface, the upper side of a guide section of the intermediate sheave is positioned at a higher level than the upper side of a guide section of the drum of the cable engine. The communication cable extends from the cable engine via the intermediate sheave up to the bow sheave. Preferably, a tension meter for the communication cable is disposed between the intermediate sheave and the bow sheave.

4 Claims, 1 Drawing Sheet

CABLE SHIP

BACKGROUND OF THE INVENTION

1. Field of the Invention

The present invention relates to a cable ship that is useful in the deployment and repair of a communication cable in the open sea.

2. Description of the Prior Art

A typical cable ship in the prior art for deploying and repairing a communication cable is shown in FIG. 2. As shown in this figure, a cable 11 is accommodated within a cable tank 2 provided inside of a hull 1.

And, in order to pay out cable 11 to the outside of the hull for deploying the cable, the cable is drawn from the cable tank 2 via a cable tank bell-mouth 3 to an inboard working deck 5, it is wrapped around a drum type cable engine 7 by about three turns through a draw-of/hold-back gear 8, then it is drawn out through a tension meter 9 up to a bow exposed working deck 6, and finally it is led out of the hull through a bow sheave 10. The cable 11 led out in the above-described manner will sink to the bottom of the sea due to its own weight. The role of the drum type cable engine 7 is to absorb the tension produced by the weight of the cable 11, and also to arbitrarily control the paying-out speed of the cable.

The drum of such a drum type cable engine 7 is installed at such a level that a repeater-amplifier wound around the drum can pass through the gap between the drum and the installation deck 4.

The level at which the upper side of the drum of the cable engine 7 is to be located is determined in relation to a tension meter 9 installed on a bow exposed working deck 6 and a bow sheave 10 mounted at such position that its upper side is located about 1.0–1.3 m above the bow exposed working deck 6. That is, the angle formed between the line connecting the upper side of the drum of cable engine 7 with the tension meter 9 and the line connecting the tension meter 9 with the bow sheave 10 may be 1/10 radian. Accordingly, the inclination and length of the bow exposed working deck 6 is determined on the basis of a working characteristic with respect to the cable 11, and once the position of the drum type cable engine 7 is determined, the height above sea level of the bow sheave 10 is decided.

In recent years, due to the increasing use of coaxial cables and optical cables owing to the rapid progress of communications engineering, the communication capacity of submarine communication cable has been abruptly increasing. As compared to the cables in the prior art, the recent cables have larger allowable radii of curvature of bending, larger diameters of their repeater-amplifiers, and especially larger lengths of their repeater-amplifier.

In order to adapt to these increases, it has been necessary in a cable ship to increase a depth of the cable tank bell-mouth 3, a drum diameter and a width of the drum type cable engine 7, and a diameter of the bow sheave 10. On the bow exposed working deck 6, the height of the cable passing over the deck 6 as taken above the same deck is preferably about 1.0 m in view of workability, and such height may be neither extremely higher nor extremely lower than 1.0 m. Further, it is not preferable, in view of maintaining the capacity of the cable tank 2, to design the installation deck 4 of the drum type cable engine 7 low. Accordingly, the height of the hull above sea level would become great, and the capacity would also increase, resulting in not only an increase in weight of the engine 7 but also in an increase in the weight of the entire ship, and so, a degradation of the stability of the ship due to a rise in the center of gravity would arise. Furthermore, an increase in the diameter of the bow sheave 10 not only would bring about an increase in weight and a rise in the center of gravity but would also reduce the interval between the lower surface of the bow sheave 10 and the water surface. Therefore, the ship would be subjected to a large impact by waves, even by small waves, as compared to the prior art. A wave-resistant characteristic of a cable ship is not designed based on the consideration that crews become uncomfortable due to hull oscillatory acceleration, nor on the consideration that navigation becomes difficult due to bottom impacts. Rather, such a characteristic is designed under a low wave condition prior to the above-mentioned state based on the fact that a hull stress is increased by the impact of waves on the bow sheave 10, or based on the fact that navigation becomes difficult due to the damage of instruments which will create problems such as the interruption of electric lamps.

Accordingly, the degree to which the bow sheave 10 is affected by wave impacts corresponds to a degree of degradation of the seafaring quality of the ship.

On the other hand, accompanying the recent great increase in the communication capacity of the submarine communication cable, in the event that faults should arise in the cable and communication should be interrupted, social and economic loss would be extremely large.

Accordingly, it is necessary to quickly send a cable ship to the spot of the cable fault, regardless of weather conditions, to effect a repair. Therefore, improvements in the wave-resistant characteristic of cable ships have become earnestly desired.

Now, in order to improve the wave-resistant characteristic of a cable ship, it is necessary to firstly make the height of the bow sheave above the water surface great. While the following measures are conceived to that end, they cannot be employed due to various reasons.

As a first measure, it may be conceived to increase the height of the installation deck 4 for the drum type cable engine 7, the relevant draw-off/hold-back gear 8, tension meter 9 and the bow exposed working deck 6, whereby the height of the bow sheave 10 is correspondingly increased. However, due to the recent increase in capacity of submarine cable, as described above, a corresponding degradation in the stability of the ship is caused by the increase in weight and rise in the center of gravity thereof. Because every possible effort in arriving at a countermeasure for this problem should be made, it is therefore not desirable to employ this first measure which would bring about a further increase in weight and further rise in the center of gravity of the ship.

As a second measure, it may be conceived to maintain the height of the drum type cable engine 7, but raise the bow sheave 10. However, if such a measure is taken, the inclination of the bow exposed working deck 6 would become large. And, in view of the effects of snowing and freezing on the working deck 6, such an increase in the inclination of the working deck is not allowable. At the present time, a maximum inclination that can be allowed in view of the effects that snowing and freezing may have is already employed in the cable ship.

Furthermore, as a third measure, it may be conceived to make the diameter of the bow sheave 10 as small as possible. However, since the diameter of the bow sheave 10 is determined depending upon an allowable radius of curvature of bending of the cable, the diameters and length of the repeater-amplifiers, and the gimbal structure, this third measure also cannot be practiced.

Accordingly, in order to make the height of the bow sheave 10 high in a cable ship, it has heretofore only been considered to enlarge the scale of the ship. However, since a wave-resistant characteristic is required, there arises a problem in that in order to increase the height of the bow sheave, a very large ship must be built even though such is not necessary with respect to the required cable capacity.

SUMMARY OF THE INVENTION

The present invention tends to resolve the aforementioned problems in the prior art, and it is one object of the present invention to provide a cable ship which can accommodate a bow sheave at an appropriately high position without the necessity of a correspondingly large hull.

According to one feature of the present invention, there is provided a cable ship including a drum type cable engine installed on an inboard deck and a bow sheave equipped at a top portion of a bow for receiving a communication cable payed out from a drum of the cable engine which will sink to the bottom of the sea, which cable ship further comprises an intermediate sheave disposed between the bow sheave and the drum type cable engine with an upper side of its guide section positioned at a higher level than the upper side of the guide section of the drum of the cable engine in order to allow the bow sheave to be disposed at a high position with respect to the water surface, the cable extending from the cable engine via the intermediate sheave up to the bow sheave.

According to the present invention, owing to the fact that a cable ship is additionally provided with an intermediate sheave in the above-described manner, the location of the bow sheave above the water surface can be comparatively high without impairing the ability of the crew to work on the cable ship.

The above-mentioned and other objects, features and advantages of the present invention will become more apparent by referring to the following description of one preferred embodiment of the invention made in conjunction with the accompanying drawings.

DETAILED DESCRIPTION OF THE PREFERRED EMBODIMENT

Figure 1:
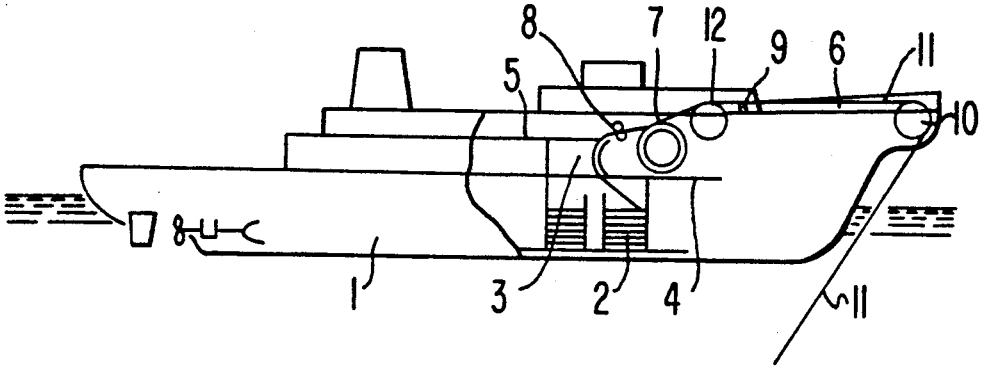
FIG. 1 is a schematic side view, partly cut-away, of a cable ship according to one preferred embodiment of the present invention.
Figure 2:
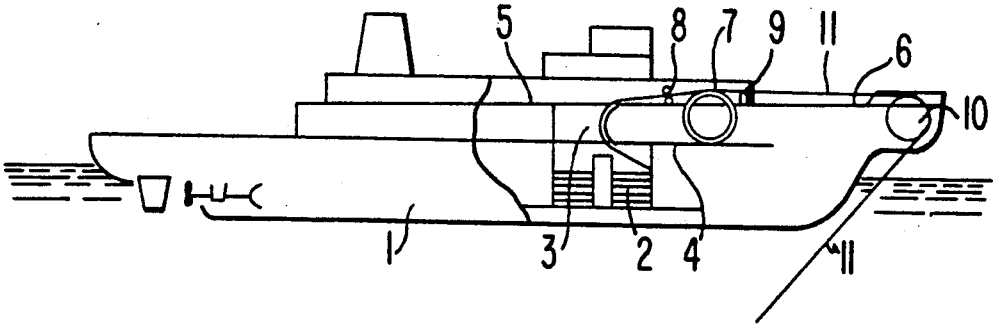
FIG. 2 (PRIOR ART)
FIG. 2 is a schematic side view, partly cut-away, of a cable ship in the prior art.

In the following, a cable ship according to one preferred embodiment of the present invention will be described with reference to the accompanying drawings. As shown in FIG. 1, for paying out a communication submarine cable 11 from an inboard cable tank 2 to sink and deploy it at the bottom of the sea or for drawing up a cable deployed at the bottom of the sea onto a ship to repair it, a bow sheave 10 is provided at the top portion of the bow. The height of the same sheave 10 with respect to the water surface is designed to be greater than that of the cable ship in the prior art, so that an impact imparted by waves to the bow sheave may be mitigated and a wave-resistant characteristic of the ship may be improved as compared to the prior art.

To that end, in order to provide a comparatively great height of the bow-sheave 10 with respect to the water surface while still realizing a necessary wave-resistant characteristic of the ship, as compared to the cable ship in the prior art, a drum type cable engine 7 and a draw-off/hold-back gear 8 are slightly displaced towards the stern, and an intermediate sheave 12 is inserted at a position in front of and obliquely above the drum type cable engine 7 and behind a tension meter 9.

In order to facilitate the disposition of the bow sheave 10 at a high position with respect to the water surface, the intermediate sheave 12 is provided between the bow sheave 10 and the drum type cable engine 7 so as to have the upper side of its guide section located at a higher position than the upper side of the guide section of the drum of the cable engine 7, and a cable 11 is disposed& so as to extend from the cable engine 7 through the intermediate sheave 12 and a tension meter 9 up to the bow sheave 10.

The relative positioning of the intermediate sheave 12 with respect to the tension meter 9, the bow exposed working deck 6 and the bow sheave 10 is identical to the relative positioning of drum type cable engine 7 with respect to the tension meter 9, the bow exposed working deck 6 and the bow sheave 10 in the above-described cable ship in the prior art.

Since the role of the intermediate sheave 12 is only to change the direction of the passing cable 11 by about 30°-60°, the diameter and width of the same sheave 12 are not required to be as large as those of the drum of the drum type cable engine 7.

In the above-described cable ship according to the present invention, the bow sheave 10 can be disposed to a necessary extent above the water surface without deteriorating the ability of the crew to work on the bow exposed working deck 6, without bringing about an increase in weight, and without deteriorating the stability of the hull. As such, the seafaring quality of the ship in waves is remarkably improved. If one tries to realize this improvement by enlarging the size of the ship as is the case with the prior art by, for example, raising the bow sheave 10 with respect to the water surface by 2 m in a cable ship of 4,000 tons in gross tonnage, a hull of about 8,000 tons in gross tonnage becomes necessary.

Whereas in a cable ship according to the present invention, an increase of only 150–200 tons in gross tonnage is required. Therefore, in view of costs, employment expense, maintenance expense and installation, remarkable advantages can be obtained according to the present invention.

As will be obvious from the detailed description above, with the cable ship according to the present invention, the following effects and advantages are obtained:

(1) A bow sheave can be supported by the hull at an appropriately high position without greatly enlarging the size of the hull.

(2) The bow sheave can be disposed to a necessary extent above the water surface without deteriorating the ability of the crew to work on a bow exposed working deck, without bringing about an increase in weight, and without deteriorating the stability of the hull, whereby the seafaring quality of the ship in waves is remarkably improved.

While a principle of the present invention has been described above in connection with one preferred embodiment of the invention, it is intended that all matter contained in the above description and illustrated in the accompanying drawings shall be interpreted to be illustrative of and not as a limitation on the scope of the invention as defined by the appended claims.

What is claimed is:

1. In a cable ship having a hull, an inboard deck, and a cable tank for accommodating a length of communication cable, equipment for paying out the communication cable from the cable tank to the outside of the hull, said equipment comprising:

a bow sheave disposed at an upper portion of the bow of the ship and rotatably supported thereat;

a cable-handling engine rotatably supported in the ship on said inboard deck for feeding cable from the cable tank to said bow sheave, said cable handling engine having a drum defining an uppermost guide section along which the communication cable extends from the cable-handling engine toward said bow sheave when said cable-handling engine is feeding cable from the cable tank; and an intermediate sheave disposed between said bow sheave and said cable-handling engine for guiding the communication cable from said cable-handling engine to said bow sheave, said intermediate sheave defining an uppermost guide section along which the communication cable is guided from the intermediate sheave to said bow sheave when said cable-handing engine is feeding cable from the cable tank, the uppermost guide section of said intermediate sheave being located at a level that is higher than that at which the uppermost guide section defined by the drum of said cable-handling engine is located with respect to sea level when the ship is afloat on the surface of a sea.

2. Equipment in a cable ship as claimed in claim 1, and further comprising a tension meter disposed between said intermediate sheave and said bow sheave.

3. Equipment in a cable ship as claimed in claim 1, and further comprising a draw-off/hold-back gear disposed between said cable-handling engine and the cable tank with respect to a direction in which cable is fed from the cable tank to said cable-handling engine.

4. In a cable ship having a hull, a box exposed working deck, an inboard deck disposed below the bow exposed working deck, and a cable tank for accommodating a length of communication cable, equipment for paying out the communication cable from the cable tank to the outside of the hull, said equipment comprising:

a bow sheave disposed at an upper portion of the bow of the ship at the end of the bow exposed working deck and rotatably supported thereat;

a cable-handling engine rotatably supported in the ship on said inboard deck for feeding cable from the cable tank to said bow sheave, said cable-handling engine having a drum defining an uppermost guide section along which the communication cable extends from the cable-handling engine toward said bow sheave when said cable-handling engine is feeding cable from the cable tank; and an intermediate sheave disposed between said bow sheave and said cable-handling engine for guiding the communication cable from said cable-handling engine to said bow sheave, said intermediate sheave defining an uppermost guide section along which the communication cable is guided from the intermediate sheave to said bow sheave above the bow working deck when said cable-handling engine is feeding cable from the cable tank, the uppermost guide section of said intermediate sheave being located above the bow working deck at a level that is higher than that at which the uppermost guide section defined by the drum of said cable-handling engine is located with respect to sea level when the ship is afloat on the surface of a sea.

* * * * *